US005802607A

United States Patent [19]

Triplette

[11] Patent Number: 5,802,607

[45] Date of Patent: Sep. 8, 1998

[54] FENCING JACKETS MADE FROM ELECTRICALLY CONDUCTIVE THREADS

[76] Inventor: Walter W. Triplette, 331 Church St., Elkin, N.C. 28621

[21] Appl. No.: 546,474

[22] Filed: Oct. 20, 1995

[51] Int. Cl.[6] ..... A41B 00/00; D03D 15/00; A63B 67/00; B32B 7/00

[52] U.S. Cl. ..... 2/1; 139/426 R; 139/420 A; 139/425 R; 428/256; 428/259; 428/381; 273/57.3; 174/55 B; 2/69

[58] Field of Search ..... 139/426 R, 420 A, 139/425 R; 428/256, 259, 381; 455/100; 273/57.3; 174/5.5 B, 5 R, 5 SG; 2/2, 69

[56] References Cited

U.S. PATENT DOCUMENTS

| | | | |
|---|---|---|---|
| 2,590,094 | 3/1952 | Egeberg et al. | 139/425 R |
| 3,069,746 | 12/1962 | Scharf | 139/425 R |
| 3,657,515 | 4/1972 | Smith . | |
| 3,699,590 | 10/1972 | Webber et al. . | |
| 3,778,331 | 12/1973 | Scharf . | |
| 3,866,909 | 2/1975 | DeSantis . | |
| 4,064,305 | 12/1977 | Wallin . | |
| 4,254,951 | 3/1981 | De Laney . | |
| 4,422,483 | 12/1983 | Zins . | |
| 4,539,714 | 9/1985 | Fratti . | |
| 4,596,053 | 6/1986 | Cohen et al. . | |
| 4,753,088 | 6/1988 | Harrison et al. . | |
| 4,761,005 | 8/1988 | French et al. . | |
| 4,929,803 | 5/1990 | Yoshida et al. | 139/425 R |
| 5,073,984 | 12/1991 | Tone et al. . | |
| 5,195,752 | 3/1993 | Reeves et al. . | |
| 5,465,423 | 11/1995 | Taylor-Varney . | |
| 5,465,424 | 11/1995 | Cudney et al. . | |
| 5,514,457 | 5/1996 | Fels et al. . | |

FOREIGN PATENT DOCUMENTS

| | | | |
|---|---|---|---|
| 1560243 | 4/1990 | U.S.S.R. | 273/57.3 |
| 1644989 | 4/1991 | U.S.S.R. | 273/57.3 |

OTHER PUBLICATIONS

Electrical World, Aug. 1, 1979, p. 46, advertisement class 174–5SB.

Electrical World, Aug. 1, 1971, p. 87, vol. 176, No. 3, advertisement, Class 174–5SB.

The Revised Foil, Charles Selberg, 1993, pp. 105,106, 110, 115,116 & 131.

*Primary Examiner*—C. D. Crowder
*Assistant Examiner*—Shirra Jenkins
*Attorney, Agent, or Firm*—Bell Seltzer Intellectual Property Law Group of Alston & Bird, LLP

[57] ABSTRACT

A garment for use in electronically-scored, contact-sports competitions is described. The garment is in the form of a fencing jacket or vest, is substantially wireless, and is woven from electrically conductive threads which cooperate with an electric sports implement to register a score when the implement contacts the electrically conductive garment. The fabric can be woven with the electrically-conductive threads extending in only one of the warp and weft directions, and preferably only in the weft direction.

19 Claims, 1 Drawing Sheet

FENCING JACKETS MADE FROM ELECTRICALLY CONDUCTIVE THREADS

FIELD OF THE INVENTION

This invention relates generally to a wireless conductive garment for use in electronically-scored contact sports, and more specifically to garments for wear during electronically-scored fencing competitions.

BACKGROUND OF THE INVENTION

Historically, many kinds of contact-type sports competitions were judged based on the injuries which one opponent inflicted on another opponent. Not only did the high probability of injury deter some gifted athletes from participating in these competitions, the audience for such events was necessarily limited to those who could stomach the witnessing of such injuries. In addition, as a result of the injuries received in the course of such competition, the competitors' careers tended to be shortened tremendously.

Because of the interest in retaining the sports competitions, while eliminating much of the injury associated therewith, efforts have been made to develop competitive versions of contact-type sports such as fencing, which can be scored by means other than a comparison of competitor injuries. One such method has been utilized in sports such as boxing; the method utilizes judges who score blows inflicted by one opponent on the other solely by their appearance. This system can be undesirable for many reasons. For example, the scoring is extremely subjective, and thus scores can vary as a result of judge bias and individual ability. Additionally, whether a judge actually sees a scoring contact can depend on his position in relation to the fighters, i.e. his line of vision. Because the judges are in different positions from each other, what appears to be scoring contact to one judge may appear to be a pulled punch or near-miss to another judge. Further, the brutality aspect is not completely removed from the scoring since, for example in boxing, a knockout equals a victory no matter what the opponents' respective scores.

In sports which utilize implements which can cause serious injury or death, such as fencing, competition is necessarily based on scoring methods other than the actual injuries inflicted to one's opponent, for public policy reasons. Therefore, attempts have been made to provide non-injury based methods for scoring such events which do not rely purely on judges' personal subjective perceptions.

One scoring method which has been developed utilizes electrically conductive fencing apparel in combination with fencing implements which are connected to an electronic scoring apparatus. When a fencing implement such as an electric foil contacts the conductive garment of a user's opponent, the scoring apparatus registers a hit. One such electrical implement/conductive apparel combination is disclosed in U.S. Pat. No. 4,254,951 to De Laney.

The conventional types of electrically conductive apparel have typically been in the form of vests or jackets woven to include a plurality of metal wires. Such wire containing garments have many drawbacks. For example, because wire tends to be stiff, the wires typically must be spaced apart sufficiently within the garment so that the wearer can maintain the ability to move somewhat freely. As a result of the spacings between the wires, the scoring device can fail to register a score as a result of a contact by the electric implement of the wearer's opponent, because the implement has contacted a spacing between the wires rather than one of the wires itself. In addition to having a tendency to be inflexible, the wires tend to be cause the garment to be heavy and uncomfortable on the wearer's body. Further, the wires tend to rust, particularly as a result of wearer perspiration. Not only is this aesthetically unappealing, but it can also represent a serious drawback to the life span of the garment, and hinder the garment's electrical conductivity. As a further disadvantage, wires tend to fatigue in response to bending, and they can eventually break following repeated bending.

Other means for providing electrically conductive scoring apparel have been attempted. For example, U.S. Pat. No. 4,761,005 discloses a device for generating an analog output signal indicating impact to a transducer. The transducer can be mounted on protective equipment such as protective vests and the like, to register impact received as a result of participation in a contact sport such as fencing. The transducer includes a layer of piezo-electric film sandwiched between thin metallized layers of electrically conductive material which can comprise layers of silver. The conductive material is adapted to be provided on regions of a garment which correspond to point-scoring regions of the wearer's body. Because the conductive material is in film form, it is necessarily continuous in the regions where conductivity and contact registrability are desired.

Attempts have been made to provide electrical charge conducting fabrics which can be used in clothing, though typically these have been provided for use in environments where static charges can represent a problem to the wearer, such as in certain regions of a nuclear submarine. For example, U.S. Pat. No. 3,778,331 to Scharf describes static charge resistant yarns which can be used to create textile fabrics for clothing and the like. The Scharf patent describes a permeable non-woven web formed of nylon fibers which is plated on its opposing faces with a non-oxidizing metal such as tin, to impart a matte, non-reflective finish thereon. The metallized paper web is then conveyed through a slitter to produce a multiplicity of metallized ribbons, which can be given yarn-like properties by conventional twisting and texturizing techniques. In addition, the ribbons may be supported on a filamentary core of nylon or other thread such as by winding the ribbon around the thread or core. In this way, the Scharf fabric purports to provide a discharge path for electric static charges without visibly introducing glitter or other metallic effects in the product.

Thus, a need exists for electrically conductive apparel which can be used for electronically-scored contact sports such as fencing and which is lightweight and durable. In addition, a need exists for apparel for electronically-scored contact type sports such as fencing, which more accurately registers all hits made by the sports implement.

SUMMARY OF THE INVENTION

With the foregoing in mind, it is an object of the present invention to provide a wireless electrically conductive garment suitable for use in contact-type sports competitions.

It is a further object of the invention to provide a garment which is substantially wireless and which is made from a fabric woven from a combination of conductive and non-conductive threads, which is sufficiently conductive to render the garment electrically conductive.

An additional object of the invention is the provision of a garment which is suitable for use in electronically-scored fencing competitions which is substantially wireless.

These and other objects are achieved by providing an electrically conductive garment which is made from a substantially wireless fabric which is woven from electrically conductive threads. The garment preferably includes front and rear panels which are joined along their respective sides at first and second side panels, to form a torso encircling garment. A crotch panel preferably extends from a lower portion of the front panel, and is adapted to cover the abdominal and crotch regions of a wearer. The crotch panel is also preferably tapered in order to leave the legs of the wearer substantially uncovered in order that their movement is unhindered.

The garment preferably includes a mock turtleneck about an upper portion of the front and rear panels, which is adapted to encirclingly cover a portion of a wearer's neck. This turtleneck is preferable formed as a separate collar-type band, and secured to the front and rear panels by conventional methods such as stitching.

An opening is preferably provided along the garment, in order to ease the donning and doffing thereof. In a preferred embodiment of the invention, the opening extends along a side of the front panel to divide the front panel into partial panels. When the garment is worn, these partial panels are overlapped and secured together by mating fasteners, such as hook and loop fasteners. The fasteners are preferably secured to the garment in a position where they do not interrupt the continuous material of the outer garment surface, in order that they do not represent an obstacle to one registering a hit upon contact with the garment with a fencing implement. It is noted, however, that an opening could be provided in other positions on the garment, such as on a side or the rear panel.

The garment also includes arm openings, which may terminate in the form of a sleeveless vest, or which may have sleeves attached thereto. The sleeves can be either conductive or non-conductive.

A strap preferably extends from a lower portion of the crotch panel and is adapted to releasably secure the crotch panel between a wearer's legs when the garment is worn. To this end, a loop is preferably secured to the rear panel of the garment, with a pair of D-rings being threaded therethrough. When the garment is donned, the strap is positioned between the wearer's legs, and the strap is fed secured to the rear panel by threading it through the D-rings in a conventional manner. In this way, the crotch panel is maintained in its desired position where it can cover and protect the vital organs of the wearer.

The electrically conductive fabric used to form the garment is woven from electrically conductive threads, and is substantially wireless. In a preferred form of the invention, the threads are nylon filaments which have been plated with silver by way of a conventional chemical deposition process. Not only are these threads more flexible than the wires conventionally used, they tend to be lighter and more resistant to oxidation. Because these threads can be woven much more tightly than the wires used in the conventional conductive apparel, it has been found that sufficient conductivity can be provided using conductive threads in only one of the warp and weft directions. Additionally, because the threads can be woven so tightly, the electrical conductivity of the garment can be maintained despite a partial loss of the conductive coating on particular threads, whereas in the conventional wire conductive garments, the garment can become useless following a break in one of the wires, particularly since the wires must be spaced so far apart. Thus, in a preferred embodiment of the invention, the fabric used to form the garment is woven with non-conductive threads, preferably of nylon, in the a first direction and conductive threads in a second direction. In a particularly preferred form of the invention, the non-conductive threads form the fabric warp and the conductive threads form the fabric weft, as this has been found to be less costly to manufacture than providing the conductive threads in the warp direction and non-conductive threads in the weft direction. Further, it is preferred that the garment be cut from the fabric so that the fabric warp direction corresponds to the vertical direction of the garment. In this way, the greater stretch associated with the weft direction can be capitalized upon in the direction where stretch is typically more greatly appreciated in garments, i.e. in the horizontal direction.

BRIEF DESCRIPTION OF THE DRAWINGS

The foregoing and other objects, features and advantages of the present invention will be made apparent from the following detailed description and from the drawings in which.

DETAILED DESCRIPTION

Figure 1:
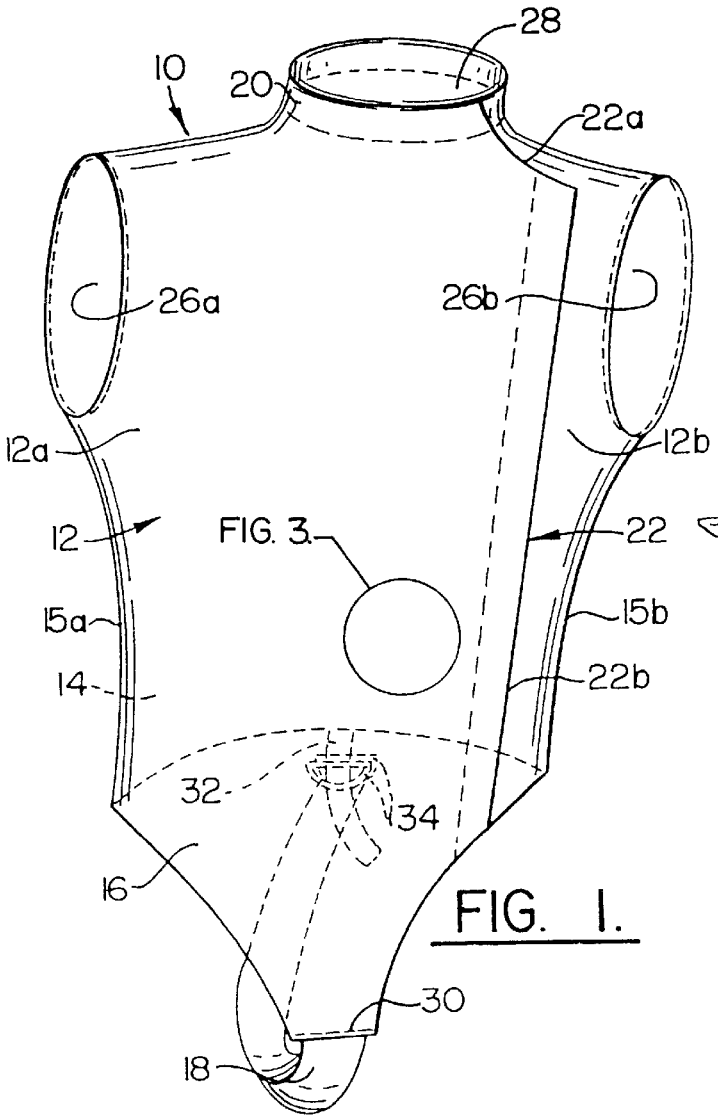
FIG. 1 is a perspective view of a fencing vest according to the present invention.
Figure 2:
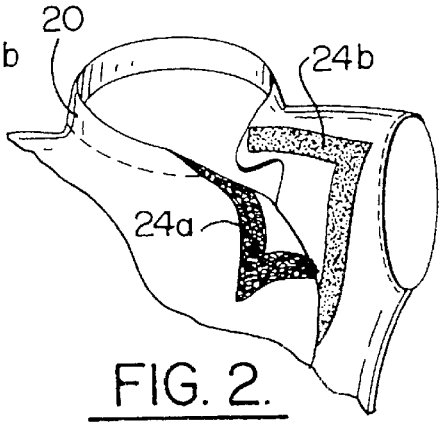
FIG. 2 is a partial sectional view of the vest of FIG. 1 with the front panel being partially opened.

With reference to FIGS. 1 and 2, the invention relates to a fencing garment, as shown generally at 10, which is made of electrically conductive threads and which is substantially wireless. The garment includes a front panel 12 for covering front torso of a wearer and a rear panel 14 for covering the rear torso of a wearer. First and second sides of the front and rear panels 12, 14 are connected along first and second side panels 15*a*, 15*b* to thereby form a torso encircling garment. The torso encircling portion is preferably adapted to fit the wearer snugly, though not so tightly that it tends to restrict the wearer's movements.

A crotch panel 16 extends from a lower portion of the front panel 12 to cover a lower abdominal and crotch region of a wearer. This crotch panel preferably tapers inwardly from the front torso 12, in order that it substantially follows the lines of the human torso from the hip bones down to the crotch region. In this way, the crotch panel 16 can extend comfortably between a wearer's legs while not hindering movement of the wearer's legs where they join the hips. Though other lower torso configurations could be utilized, the tapered configuration depicted is particularly preferred because it does not hinder a wearer from performing the lunging movements which are utilized in the sport of fencing. The crotch panel 16 is preferably formed as an integral extension of the front panel 12, as this decreases the number of pieces which must be used to construct the garment, and therefore decreases the required input of labor required for its manufacture.

A strap 18 extends from the lower portion of the crotch panel 16 and is designed to releasably secure the crotch panel between a wearer's legs in order that the wearer's lower abdominal and crotch regions are securely covered by the fencing garment. In this way, it can be ensured that the vital organs of the wearer are protected from accidental injury during fencing competitions. It a preferred embodiment of the invention, the strap 18 is designed to be releasably and adjustably securable to the rear panel 14 of the garment 10 in order that the garment can be made to comfortably fit wearers of different sizes, as will be discussed further herein.

The fencing garment 10 preferably has a mock turtleneck 20 located about an upper portion of the front and rear panels 12, 14, which is adapted to encircle and cover a portion of a wearer's neck. This mock turtleneck 20 is preferably formed as a separate collar-type band which is secured about upper portions of the front and rear panels 12, 14 in a conventional manner. In a particularly preferred form of the invention, a band of edging material (not shown) is secured about the free neck-encircling end (i.e. the upper end) of the mock turtleneck 20, as this provides a smooth edge thereto. In this way, the free or upper end of the mock turtleneck can be kept from chafing the skin on the wearer's neck, which can tend to particularly tender. It is noted, however, that the length of the turtleneck 20 could be extended in the form of a standard full turtleneck, or shortened to extend to a lesser extent, if at all, on the wearer's neck.

The garment 10 also desirably includes an opening 22 extending along at least a portion of its vertical length in order that the garment can be easily donned and doffed. This opening 22 preferably extends along a side of the front panel 12 to divide the front panel into partial panels 12*a* and 12*b*, as this position has been found to produce an easily donnable garment. The opening 22 of this preferred embodiment desirably includes a substantially horizontally extending portion 22*a* and substantially vertically extending portion 22*b*.

This opening configuration coupled with the offset position thereof provides a smooth fit of the mock turtleneck portion 20 and the garment, while providing a substantially uninterrupted surface about the center of the front panel 12. Because the majority of the fencing blows are typically received in the center of the front panel 12, this embodiment provides the advantage of a relatively uninterrupted target area. It will be noted, however, that other opening locations and configurations can be provided, without departing from the spirit of this invention.

As shown more clearly in FIG. 2, the opening 22 is selectively closable by overlapping partial panels 12*a*, 12*b* and securing them by way of mating fasteners 24*a* and 24*b*. Although the mating fasteners illustrated are of the hook and loop variety, other types of conventional fasteners, such as snaps, zippers and the like could be used in addition to or in place of the hook and loop fasteners shown. It is preferred that the fasteners 24*a*, 24*b* be provided on the underside of the overlapping partial panel portion (here portion 12*a*) and the upper side of the overlapped partial panel portion (here portion 12*b*) in order that the electrically conductive fabric is not interrupted by fasteners on the outer surface of the garment. In this way, the electrically conductive fabric is continuous about the outwardly facing surface of the garment, and there are no fasteners on the garment outer surface which can interfere with a wearer's opponent registering a hit due to contact with a fastener rather than the conductive fabric. It has been found that the hook and loop fasteners 24*a* and 24*b* illustrated securely close the opening 22 and allow a small amount of adjustability to the garment as well, since the hook and loop fasteners can be slightly offset while still effecting a secure engagement. In addition, these hook and loop fasteners are known to be cost effective and they do not have the negative side effects typical of some other closures, e.g. the tendency for metal zippers and snaps to rust.

As illustrated in FIGS. 1 and 2, the garment includes arm openings 26*a* and 26*b* for receiving the arms of a wearer. The garment 10 can be substantially sleeveless, to form a vest substantially as shown. Alternatively, the garment could be provided with sleeves (not shown) in a conventional manner, to form a short sleeved or three-quarter length to long sleeved jacket. In the sleeved embodiments, the sleeves can be made from the same electrically conductive fabric as is used to make other parts of the garment (discussed further herein). Alternatively, in situations where it is not considered important for the sleeves to be electrically conductive, they can be made from non-conductive material.

To conform with competitive fencing regulations, the garment desirably includes a full-lining 28 which is preferably made from a woven nylon fabric. However, it will readily be recognized at other types lining materials conventionally known in the art could also be used. Further, an internal lining which is adapted to be more comfortable (e.g. softer) to a wearer could be provided in addition to or instead of the nylon lining 28. As a further alternative, the lining could be provided in only portions of the garment, as for example in the sleeved jacket embodiment, the torso portion of the garment could be lined while the sleeves remain substantially unlined.

Figure 3:
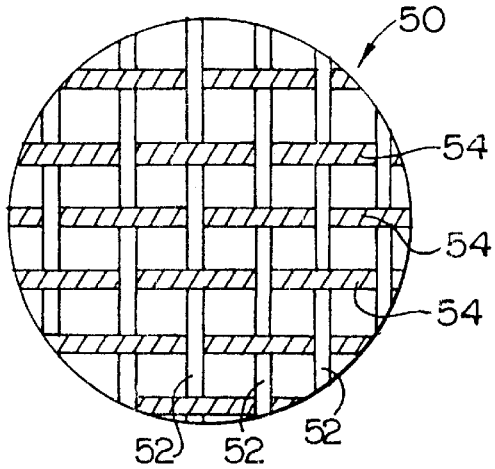
FIG. 3 is an enlarged view of a fabric construction used in FIG. 1 to form the electrically conductive layer of the present invention.

As shown more clearly in FIG. 3, the conductive material from which the garment is made is substantially wireless and utilizes a plurality of conductive threads for garment conductivity. In this way, the disadvantages associated with metal wire, e.g. rusting, discomfort, excess weight, and shortened lifespan, can be avoided. In addition, the conductive threads have sufficient strength that they can withstand repeated contact by the various implements used in competitive fencing. In a preferred form of the invention, the conductive threads are made of nylon which has been plated with silver by way of a chemical deposition process. It has been found that threads from about 150 to 250 denier, and preferably about 200 denier, are particularly preferred in forming the garment of the present invention, as this provides a garment which is sturdy and durable enough to withstand the contacts from the fencing implements, including the slashing moves typically inflicted with the fencing saber. In addition, fabrics made from threads of this size have been found to be sufficiently flexible that they enable the fencer to move freely without being unduly hindered by the garment.

It has been found that a garment can be produced which provides sufficient conductivity to allow for accurate registration of contacts in fencing competitions using a woven fabric which only has conductive threads in a single direction. As shown in FIG. 3, non-conductive threads 52 extend in a first direction in the fabric 50, while conductive threads 54 extend in a second direction. Because the threads are a great deal more flexible than the wires used in traditional conductive garments, they can be woven much more tightly than has heretofore been possible with the wires. Because the fabric used in the present invention can be so tightly woven, it has been found that the conductive threads can be provided in only one direction of the woven fabric, and sufficient conductivity can still be provided. Because the conductive threads typically are more expensive and difficult to produce than non-conductive threads, by reducing the amount of conductive threads required, the cost and labor required to form the conductive fabric are reduced as well. It has been found that production of the woven fabric is more cost effective when the conductive threads are provided only in the weft direction while nonconductive threads are provided in the warp direction. Therefore, it is preferred that the fabric used to form the garment be manufactured to have nonconductive threads in the warp and conductive threads in the weft. It is also preferred that the garment be cut from the woven fabric such that the warp extends vertically along the garment while the weft extends horizontally across the garment, as fabrics tend to stretch slightly more in the weft or filling direction. Therefore, by cutting the garment from the fabric in this direction, a more comfortable garment can be provided.

The strap 18 can be in the form of conventional nylon webbing such as that used to form the straps on bags, back-packs or the like, and may be attached to the crotch panel 16 by way of stitching 30. It will readily be recognized, however, that other forms of attachments such as gluing, thermal bonding or the like could be used to attach the strap to the crotch panel. In a preferred form of the invention, a loop 32 is secured to the rear panel 14 of the garment 10 by way of stitching or other conventional methods of attachment. This loop 32 may be made of nylon webbing, such as is used to form the strap 18. The loop 32 preferably extends through a pair of D-ring type fasteners 34, such that the D-ring type fasteners hang from the rear panel 14 by way of the loop. In this way, when the garment 10 is donned by a wearer, the strap 18 can be positioned between the legs of the wearer, then looped through the pair of D-rings 34, to thereby secure the strap in its proper position on the wearer's body. While the D-rings 34 are preferred due to their low cost and because they allow a large degree of strap adjustability, it is noted that other forms of attachment can be provided for securing the strap between the wearer's legs, such as snaps, hook and loop fasteners, buttons or the like. As a further alternative, a loose strap can be provided in place of the loop 32 and it could be tied into a knot with the strap 18 to secure the crotch panel in its proper position. It is also noted that forms of securing the crotch panel 16 about the vital organs of the wearer other than the strap 18 shown could be provided. For example, a patch of hook or loop fastener material could be secured to a lower portion of the crotch panel 16 and a mating piece of fastener material could be secured to the lower torso covering garment worn by the wearer. However, because the strap method discussed above enables the electrically conductive garment 10 to be worn in combination with many types of apparel without requiring alteration thereto, this method is particularly preferred.

The conductive garment 10 according to the present is used in the manner of conventional wire garments in combination with specially constructed implements and an electronic scoring device. Where the garment is a fencing vest or jacket, the garment is preferably attached to a scoring device by way of a body cord. Another body cord is attached to the fencing implement, e.g. fencing foil or saber, of the wearer's opponent, to connect the implement to the scoring device. The body cords are preferably connected to cable reels, in order that they can readily be wound and unwound as the athletes move during competition. An electrical path runs through the body cord to the tip of the fencing implement, which is depressible upon contact, for example. The depressible tip is specially constructed so that the electrical path is modified as a result of contact with the conductive jacket, and the contact is registered by the scoring apparatus. Likewise, the tip can be adapted to register contact with non-conductive objects, with the scoring apparatus differentiating between the hits to the respective targets based on their conductivity or lack thereof. Such electrical scoring device/sports implement combinations which utilize conductive targets are known in the art, and the present invention could be used in combination with any of such conventional devices, with the invention not being limited to a particular type of scoring implement or registering device.

In the drawings and specification, there have been disclosed typical preferred embodiments of the invention and, although specific terms are employed, they are used in a generic and descriptive sense only and not for purposes of limitation, the scope of the invention being set forth in the following claims.

I claim:

1. A wireless electrically conductive garment for use in electrically-scored contact sports competitions, the garment comprising a body portion for covering at least a portion of an upper torso of a wearer, at least a portion of said garment being made from a woven fabric having conductive threads woven in a first direction and non-conductive threads woven in a second direction, said conductive threads enabling said woven fabric to transport an electrical current provided by a contacting electric fencing implement to thereby enable registration of contact between the garment and an electric implement by a scoring apparatus.

2. A wireless electrically conductive garment according to claim 1, wherein said woven fabric is formed with substantially all conductive threads in a first direction and substantially all non-conductive threads woven in a second direction.

3. A wireless electrically conductive garment according to claim 1, wherein said first direction is the weft direction and said second direction is the warp direction of said woven fabric.

4. A wireless electrically conductive garment according to claim 1, wherein said conductive threads are silver-plated nylon.

5. A wireless electrically conductive garment according to claim 1, wherein said non-conductive threads include nylon.

6. A wireless electrically conductive garment according to claim 1, wherein said conductive and non-conductive threads are about 150–250 denier in size.

7. A wireless electrically conductive garment according to claim 1, wherein the garment is a fencing garment shaped to cover substantially only the upper torso and crotch regions of a wearer.

8. A wireless garment comprising:

a front panel for covering the front torso of a wearer, a rear panel for covering the rear torso of a wearer, first and second side panels connecting first and second sides of said front panel to first and second sides of said rear panel, to thereby form a torso encircling garment, and a crotch panel secured to a lower portion of said front panel for covering a lower abdominal and crotch region of a wearer, and a strap for releasably securing said crotch panel between a wearer's legs, wherein at least said front and crotch panels are made from a wireless fabric comprising conductive threads, said fabric being adapted to transport an electrical current provided by a contacting electric fencing implement to enable registration of a contact between the garment and the fencing implement by a scoring apparatus.

9. A wireless garment according to claim 8, wherein said fabric is a woven fabric having conductive threads woven in a first direction and non-conductive threads woven in a second direction.

10. A wireless garment according to claim 9, wherein said fabric is woven with conductive threads in the weft direction and non-conductive threads in the warp direction.

11. A wireless garment according to claim 9, wherein said conductive threads are silver-plated nylon.

12. A wireless garment according to claim 9, wherein said conductive threads and said non-conductive threads are approximately 150–250 denier in size.

13. A wireless garment according to claim 8, further comprising releasable fastening means secured to said rear panel for mating engagement with said strap, to thereby secure the crotch panel between a wearer's legs.

14. A wireless conductive garment for use in electronically-scored contact sports comprising:

an upper torso encircling garment having front and rear panels connected along first and second side panels for covering the upper torso of a wearer, a crotch panel secured to a lower portion of said front panel for covering a lower abdominal and crotch region of a wearer, and strap means for releasably securing said crotch panel between a wearer's legs, and wherein at least said front and crotch panels are woven from a fabric comprising conductive threads such that said fabric can transport an electrical current provided by a contacting electric fencing implement to thereby cause a registration of the contact between the garment and the fencing implement by a scoring apparatus.

15. A wireless conductive garment according to claim 14, wherein said conductive threads are silver-plated nylon.

16. A wireless conductive garment according to claim 14, wherein said fabric comprises substantially all non-conductive threads woven in a warp direction of the fabric.

17. A wireless conductive garment according to claim 16, wherein said fabric comprises about 150–250 denier conductive threads woven in a weft direction of the fabric and said non-conductive threads are about 150–250 denier in size.

18. A wireless conductive garment according to claim 17, wherein the warp direction of the fabric extends vertically along said front and rear panels.

19. A wireless electrically conductive garment comprising a body portion for covering at last a portion of an upper torso of a wearer, said garment being made from a woven fabric having a warp formed substantially entirely of nylon threads about 150–250 denier in size, and a weft formed substantially entirely of electrically conductive silver-plated nylon threads about 150–250 denier in size, said conductive threads enabling said woven fabric to transport an electrical current provided by a contacting electric fencing implement to thereby cause registration of a contact between said garment and the electric implement by a scoring apparatus.

* * * * *